United States Patent [19]

Reich

[11] 4,147,378

[45] Apr. 3, 1979

[54] DEVICE FOR USE WITH A SKI BINDING

[75] Inventor: Kaspar Reich, Wattwil, Switzerland

[73] Assignee: Werner Herzig, Wattwil, Switzerland

[21] Appl. No.: 783,780

[22] Filed: Apr. 1, 1977

[30] Foreign Application Priority Data

Apr. 8, 1976 [CH] Switzerland ..... 4470/76

[51] Int. Cl.[2] ..... A63C 9/08

[52] U.S. Cl. ..... 280/633

[58] Field of Search ..... 280/626, 631, 636, 623

[56] References Cited

U.S. PATENT DOCUMENTS

| | | | |
|---|---|---|---|
| 2,433,161 | 12/1947 | Schwarze | 280/623 |
| 3,989,273 | 11/1976 | Schmidt | 280/631 |

*Primary Examiner*—Robert R. Song

*Attorney, Agent, or Firm*—Lane, Aitken & Ziems

[57] ABSTRACT

A device for a ski binding for supporting a heel holder component at the ski, wherein a spring is interposed between the heel holder component and the ski. The spring serves for the resilient movement of the heel holder component and ski towards one another at least approximately at right angles to the plane of the ski.

8 Claims, 2 Drawing Figures

DEVICE FOR USE WITH A SKI BINDING

BACKGROUND OF THE INVENTION

The present invention broadly relates to the ski binding art, and, more specifically, concerns a new and improved construction of device for use with a ski binding, for supporting a heel holder or heel holder component at the ski.

When constructing ski boots and ski bindings a factor which has had devoted thereto increasingly greater attention is the requirement that as little play as possible exists between the foot of the skier and the ski, so that any movement of the body of the skier is transmitted without play to the ski in order for the skier to have the best possible control over the skis. Yet this connection between the skier's foot and the ski as free as play as possible in the plane of the ski, however also results in an equally play-free connection between the foot and the ski in a plane dispositioned at right angles to the plane of the ski inasmuch as the foot is tightly clamped at all sides in the ski boot and the boot equally is clamped at all sides in the ski binding. Any impact which is transmitted from the ski piste or trail to the bottom of the ski therefore is propagated to the foot without any appreciable dampening. Since the trend is to increasingly better groom or prepare the ski pistes or trails, i.e. there is a definite trend towards a harder preparation of the surface of the ski pistes, and furthermore, since the developing trend likewise is to do less touring skiing and more skiing upon trails, it is certainly not surprising that there are a greater number of injuries arising during skiing. Thus, skiers increasingly complain about pains in the back due to the strong sudden-like loading of the spinal chord, since many of the impacts which are transmitted from the skiing pistes to the ski are not properly elastically-resiliently absorbed by a number of skiers through correct positioning of the body during skiing.

SUMMARY OF THE INVENTION

Hence, with the foregoing in mind it is a primary object of the present invention to provide a new and improved construction of device for use in conjunction with a ski binding wherein it is possible to avoid the aforementioned drawbacks, or at least is capable of reducing the disadvantageous effects arising during skiing as above-explained.

Still a further significant object of the present invention aims at the provision of a device which effectively cushions forces encountered during skiing and otherwise undesirably transmitted to the body of the skier, especially, although not exclusively, those times arising when the skier uses an improper skiing technique i.e. body position.

Yet a further significant object of the present invention aims at providing a novel construction of device which can be interposed between a heel holder and the ski in order to cushion the blows and impacts transmitted to the skier, particularly when skiing upon hard pistes, trails or the like.

Now in order to implement these and still objects of the invention, which will become more readily apparent as the description proceeds, the device of the present development is manifested by the features that a spring is interposed between a heel holder component and the ski for the resilient relative movement towards one another of the heel holder component and the ski in a direction at least approximately at right angles to the plane of the ski.

Due to these measures, as contemplated by the invention, the blows or impacts which are exerted during skiing from the ski pistes to the ski are transmitted to the aforementioned spring or resilient element, and are thus not rigidly transferred to the ski binding and from that location to the ski boot. Between the skier's foot and the ski there is thus now interposed a spring.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
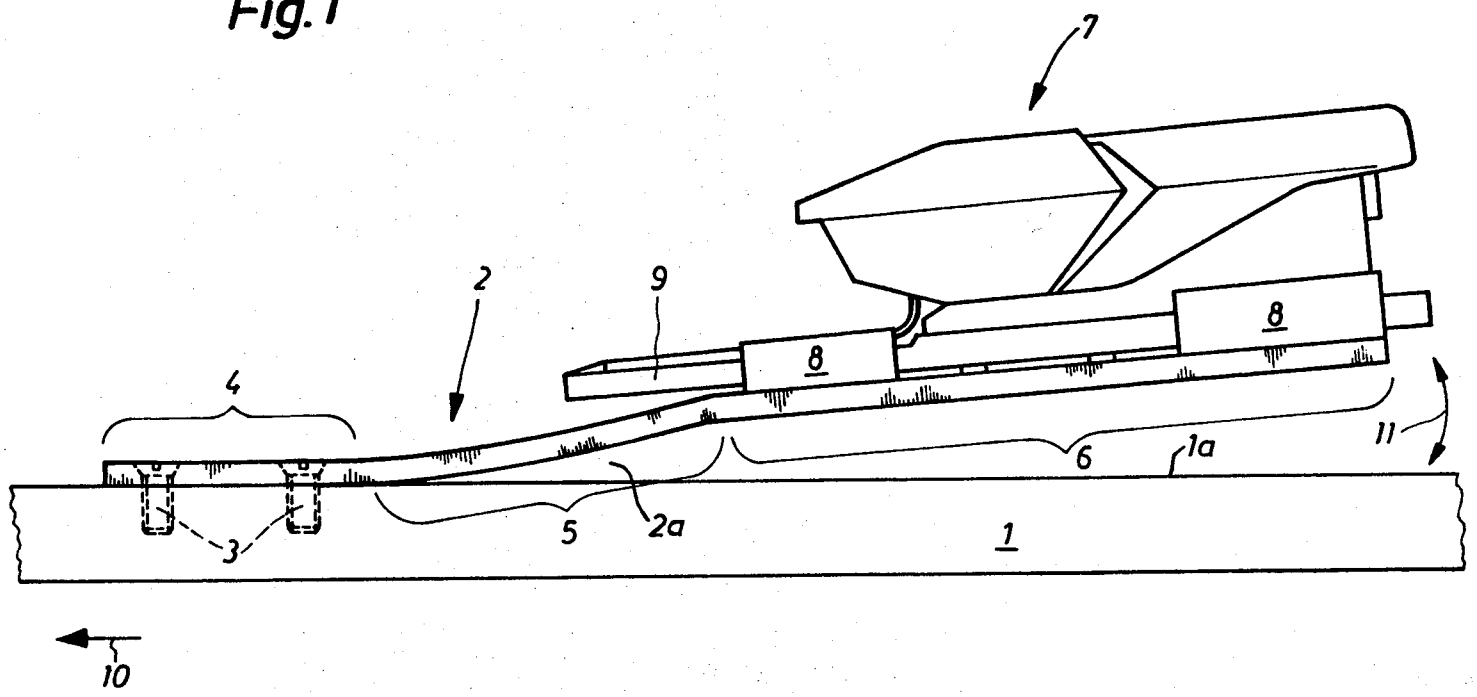
FIG. 1 is a side view illustrating a first embodiment of the inventive device, with only part of the ski being shown in order to simplify the illustration.

Describing now the drawings, a first embodiment of the invention will be considered by way of example with reference to FIG. 1, wherein it will be recognized that a resilient element, here shown in the form of a leaf or plate spring 2 and constructed as a free arm is attached to the top surface of a ski 1 by means of screws 3 or any other suitable fastening expedients. The leaf spring 2 comprises a first surface region 4 which is supported at the ski 1, an adjoining intermediate region 5 and a second surface region 6 which carries a heel holder component 7, for instance an automatic heel step-in holder of a safety ski binding. The heel holder component 7 is attached by means of the bearing blocks 8 at the second surface region 6 of the leaf spring 2. A base plate 9 of the heel holder component 7 is adjustably retained in the bearing blocks 8 in conventional manner.

The ski 1 extends towards the ski tip in the direction indicated by the arrow 10. To simplify the showing of the drawings the entire ski has not been illustrated, particularly since its construction is unimportant for the understanding of the invention and is not related thereto. The first surface region 4 and the second surface region 6 of the leaf spring 2 are located in spaced relationship from one another. Both of the spring regions 5 and 6 constitute the free arm of the leaf spring 2, which may be considered to be rigidly clamped at the region 4. The intermediate region 5 of the leaf spring 2 is oriented at an acute angle with respect to the plane of the ski 1. The second surface region 6 of the leaf spring 2 or equivalent structure, is located at a somewhat lesser inclination with regard to the plane of the ski 1.

Now when a skier stands upon the ski 1 with the heel of the ski boot held by the heel holder component 7 (the toe holder of the safety ski binding for retaining the toe box or toe portion of the ski boot has not been shown since such structure is conventional), then the leaf spring 2 is tensioned by the weight of the skier, so that the second surface region 6 of the leaf spring moves closer to the top surface 1*a* of the ski 1, but does not bear against such ski surface. In the illustration of the device shown in FIG. 1 the same has been portrayed without any load applied thereto, i.e. when a skier is not standing upon the ski 1. When the skier is standing at rest upon the ski 1, the spring 2 is thus somewhat prebiased or stressed and part of the intermediate region 5 of the leaf spring 2 comes to bear at the ski 1 and, therefore, becomes an effective extension of the first surface region 4 of such spring. In other words: this means that with increasing approach of the surface region 6 to the top surface 1*a* of the ski the effective length of the spring 2 is increasingly reduced. Consequently, the fixed support of the spring 2 at the ski 1 therefore increasingly migrates from the surface region 4 towards the rear of the ski. Now since part of the region 5 of the spring 2 has effectively become incorporated or simply constitutes an extension of the first surface region 4, since such part of the region 5 which bears against the top surface 1*a* of the ski no longer is effective as a spring, it is possible to state that the spacing between the first surface region 4 and the second surface region 6 of the leaf spring 2 reduces with increasing loading of the spring. In addition to changing the effective spring length it is also possible to alter the spring characteristic of the leaf spring 2. This can be accomplished for instance by designing the thickness and/or the width of the leaf spring 2 so as to vary. Therefore, viewing the leaf spring 2 in its lengthwise extent such then possesses a variable cross-sectional area.

Figure 2:
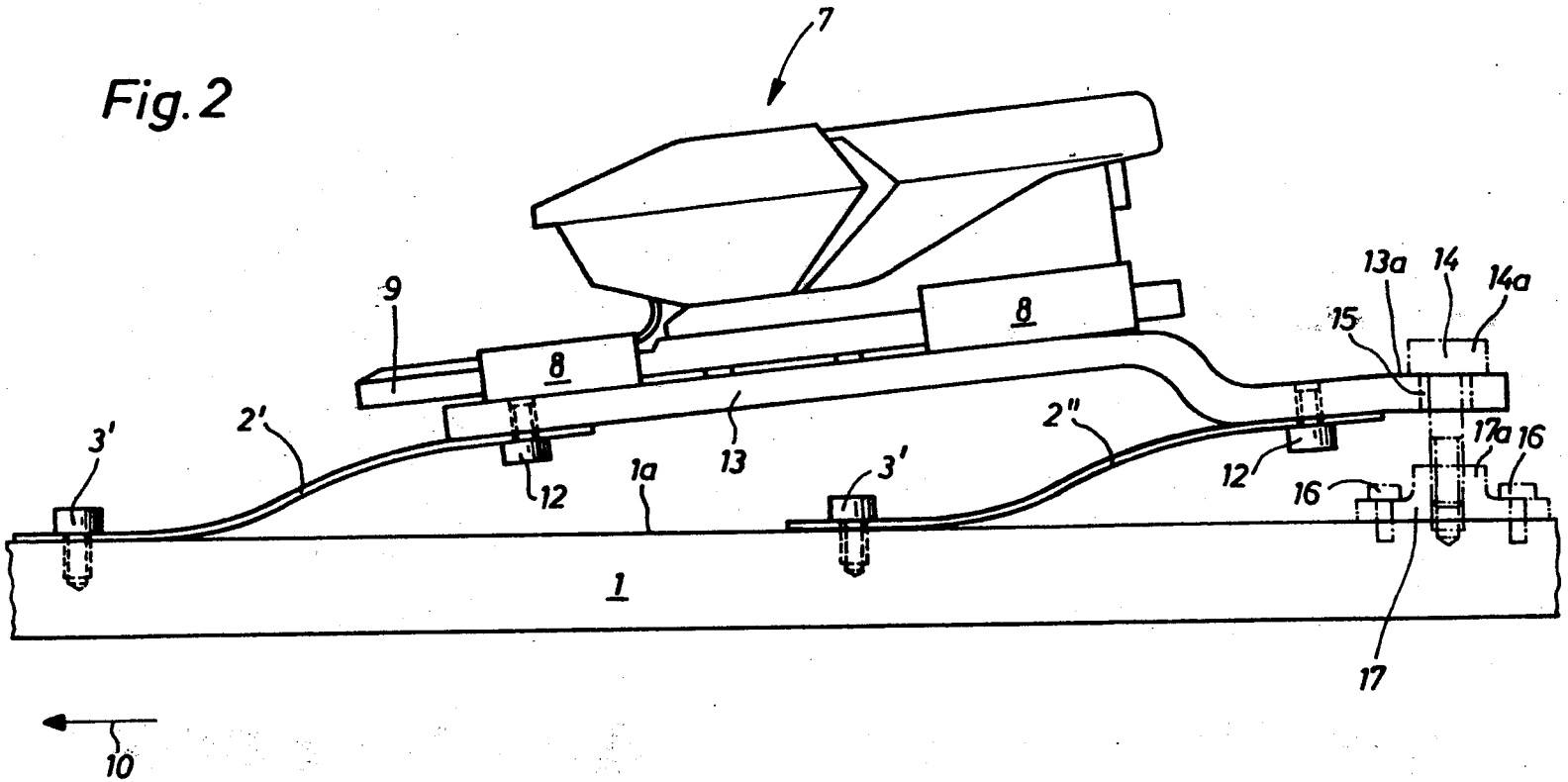
FIG. 2 is a side view, similar to the showing of FIG. 1, of a second exemplary embodiment of the invention.

In FIG. 2 there is illustrated a preferred constructional embodiment of the inventive device. It is also here remarked that the same components have been designated with the same reference characters used for the embodiment of FIG. 1. In this case, however, the resilient element, namely the spring, consists of two parts 2' and 2''. These spring parts or elements 2' and 2'' are attached by means of screws 3' or equivalent structure at the ski 1 and by means of screws 12 at a plate 13. The bearing or mounting blocks 8 are threadably connected in any convenient fashion with the plate 13. The spacing between the screws 3' and 12 at the spring part or element 2' must be equal to the spacing between the screws 3' and 12 at the spring part or element 2'', in order that the plate 13 can be resiliently mounted relative to the ski 1. The springs or spring parts 2' and 2'' can be completely identical, but also they can be different from one another, so that for instance one spring part or element is softer than the other.

Continuing, the plate or plate member 13 can also be provided with a screw 14 or equivalent structure, which extends through an elongate hole or opening 15 of the plate 13. The screw 14 is adjustably threaded into a bearing or mounting block 17. This bearing or mounting block 17 is attached by means of screws 16 or equivalent structure with the top surface 1*a* of the ski 1. The head 14*a* of the screw 14 bears against the top surface 13*a* of the plate 13. The screw 14 accomplishes two purposes. Firstly, by means of such screw 14 it is possible to selectively pre-bias or stress the spring parts or elements 2' and 2''. Furthermore, the head 14*a* of the screw 14 serves as a stop or impact means, in order to ensure that the plate 13 can only be pivoted away from the ski 1 through a limited extent. Plate 13 can only be moved through a distance corresponding to the spacing between the lower surface of the head 14*a* of the screw 14 and the central hub 17*a* of the bearing or mounting block 17.

According to a not particularly illustrated exemplary embodiment, it is possible to adjust the spacing between the first surface region 4 and the second surface region 6 of the leaf spring 2 also in the rest condition of the leaf spring, in other words when the same is not loaded by the weight of the skier. This can be accomplished, for instance, by dispensing with the use of the screws 3 for attaching the first surface region 4 at the ski 1, and instead, adjustably arranging the first surface region 4 of the leaf spring 2 within a holder attached to the ski 1, so that the first surface region 4 of the spring can be adjusted relative to the ski 1 in the lengthwise direction of such ski. Since of course it is necessary to maintain unchanged the spacing of the heel holder component 7 from the not particularly illustrated conventional toe holder of the safety ski binding, the undertaken adjustment of the first surface region 4 of the spring 2 relative to the ski 1 must be compensated by a corresponding adjustment of the plate 9 within the bearing or mounting blocks 8. In order to change the effective spring length, with the device in its unloaded state, it would be possible to provide a holder which supports the first surface region 4 of the spring 2 and itself is supported at the ski 1 and can be shifted relative thereto in the lengthwise direction of the ski. Then the flow of the forces i.e. force flux is accomplished from the leaf spring 2 by means of the aforementioned holder to the ski 1, and the stationary supporting location of the spring can be adjustably shifted along the ski. The first surface region 4 then is no longer secured by means of the screws 3 or equivalent structure to the ski 1. Furthermore, instead of the convex curved intermediate region 5 of the leaf spring 2, viewed with respect to the plane of the ski and as shown in FIG. 1, this intermediate region 5 also could be of flat or planar configuration.

According to a still further not particularly illustrated embodiment of the invention the leaf spring need not be designed as a free arm as heretofore explained, rather can be in the form of a bracket-shaped spring. At the second surface region 6 there is then arranged to merge or connect therewith a spring end portion which depends downwardly towards the top surface 1*a* of the ski and bears thereagainst so as to be freely movable thereat, in other words, is bent for instance somewhat towards the rear end of the ski, so that such spring end portion, during bending-through of the leaf spring 2, can freely slide along the ski 1.

According to a still further not particularly shown embodiment the spring can also consist of a rubber elastic or elastomeric material. The then provided rubber spring also could be, of course, used in addition to the leaf spring 2, so that, for instance, the elastomeric material is located in the substantially wedge-shaped gap, such as generally indicated by reference character 2*a*, in the arrangement of FIG. 1, which exists between the ski 1 and the leaf spring 2. It would also be conceivable to provide instead of the leaf spring 2 a sole plate as conventionally used at the present time already with a number of safety ski bindings and which is pivotably mounted at the region of the toe holder, so that the sole or release plate can be rocked in a plane disposed substantially at right angles to the plane of the ski, and then such sole plate is supported directly or through the intermediary of a rod at a spring, for instance a rubber spring or helical or coil spring.

If the spring is designed as a helical or coil spring, then such can be a pressure spring or a tension spring.

A still further embodiment of the invention, contemplates disposing the helical spring such that its lengthwise axis is oriented at least approximately parallel to the plane of the ski, and a push- or pull rod, bearing at the helical spring, in conjunction with a plate carrying the heel holder or heel binder component 7, and which plate is hingedly connected at the ski 1 to be pivotable in a plane disposed at right angles to the plane of the ski, forms a toggle lever, so that during rocking of the plate in an approximately vertical plane it is possible to load the helical spring by means of the push- or pull rod or the like.

With all of the herein disclosed exemplary embodiments of the inventive device there is thus carried out a pivoting or rocking of the heel holder or heel binder component 7 in the direction of the double-headed arrow 11 against the force of an intermediately disposed or intermediately connectable spring. It is possible to design the device such that it can be disconnected or rendered ineffectual when desired, by way of example if the illustrated leaf spring 2 bears with its surface region 6 completely against the top surface 1*a* of the ski 1 and is arrested or locked in this position by any suitable locking or arresting means. If the leaf spring 2 is effectual, then during leaning back of the skier and owing to loading of the rear portion of the ski which is thus accomplished, the spring 2 is markedly moved in the direction of the ski 1. Consequently, the ski boot has imparted thereto also a very slight inclination with respect to the plane of the ski 1. The forward portion of the ski 1 is thus essentially relieved of load in relation to the loading of the ski when the skier does not lean back. This especially pronounced removal or load relief at the forward portion of the ski can be of advantage for certain skiing techniques.

While there are shown and described present preferred embodiments of the invention, it is to be distinctly understood that the invention is not limited thereto, but may be otherwise variously embodied and practiced within the scope of the following claims. Accordingly,

What is claimed is:

1. A device for use in conjunction with a ski binding for supporting a heel holder component at the ski, comprising:

compression spring means interposed between the heel holder component and the ski wherein the heel holder component is mounted on the spring means;

said spring means being supported with one end on the heel holder component and with the other end on the ski said spring means tending to push the heel holder component away from the ski;

said spring means allowing for a resilient movement of the heel holder component and the ski towards one another at least approximately at right angles to a plane containing the ski whereby in the start position of the ski binding, the ski and the heel holder component are provided with a space therebetween.

2. A device for use in conjunction with a ski binding for supporting a heel holder component at the ski, comprising:

at least one leaf spring interposed between the heel holder component and the ski;

said leaf spring embodying a first surface region and a second surface region;

said first surface region and said second surface region being arranged in spaced relationship from one another;

said first surface region being supported at the ski;

said second surface region carrying the heel holder component; and said leaf spring allowing a resilient movement of the heel holder component and the ski towards one another at least approximately at right angles to a plane containing the ski.

3. The device as defined in claim 2, wherein:

said leaf spring is structured as a free arm.

4. The device as defined in claim 2, wherein:

said leaf spring further includes an intermediate region between said first surface region and said second surface region;

said intermediate region of said leaf spring increasingly bearing at the surface of the ski with increasing coming together of the heel holder component and the ski such that said intermediate region in effect becomes part of the first surface region.

5. The device as defined in claim 4, wherein:

said intermediate region of the leaf spring is inclined with respect to the plane of the ski.

6. The device as defined in claim 4, wherein:

said intermediate region of the leaf spring is curved substantially convexly with respect to the surface of the ski.

7. A device for use in conjunction with a ski binding for supporting a heel holder component at the ski, comprising:

at least two spring elements interposed between the heel holder component and the ski;

means for connecting one respective end of each spring element with the ski;

a plate supporting the heel holder component;

means for attaching the other respective end of each spring element with said plate; and said spring elements allowing a resilient movement of the heel holder component and the ski towards one another at least approximately at right angles to a plane containing the ski.

8. The device as defined in claim 7, further including:

an adjustable stop means for limiting the resilient pivotal displacement path of said plate.

* * * * *